US010887692B1

(12) United States Patent
Rasumow et al.

(10) Patent No.: US 10,887,692 B1
(45) Date of Patent: Jan. 5, 2021

(54) MICROPHONE ARRAY DEVICE, CONFERENCE SYSTEM INCLUDING MICROPHONE ARRAY DEVICE AND METHOD OF CONTROLLING A MICROPHONE ARRAY DEVICE

(71) Applicant: Sennheiser electronic GmbH & Co. KG, Wedemark (DE)

(72) Inventors: Eugen Rasumow, Wedemark (DE); Sebastian Rieck, Eggingen (DE); Fabian Logemann, Hannover (DE); Jens Werner, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/503,835

(22) Filed: Jul. 5, 2019

(51) Int. Cl.

| | |
|---|---|
| ***H04R 3/00*** | (2006.01) |
| ***G10L 21/0232*** | (2013.01) |
| ***H04R 1/40*** | (2006.01) |
| *G10L 21/0208* | (2013.01) |

(52) U.S. Cl.
CPC ..... *H04R 3/005* (2013.01); *G10L 21/0232* (2013.01); *H04R 1/406* (2013.01); *G10L 2021/02082* (2013.01)

(58) Field of Classification Search
None
See application file for complete search history.

(56) References Cited

U.S. PATENT DOCUMENTS

| | | | | |
|---|---|---|---|---|
| 9,894,434 | B2 | 2/2018 | Rollow, IV et al. | |
| 2012/0243698 | A1* | 9/2012 | Elko | H04M 9/082 381/66 |
| 2016/0336913 | A1* | 11/2016 | Kuruba Buchannagari | H03G 3/32 |

* cited by examiner

*Primary Examiner* — James K Mooney
(74) *Attorney, Agent, or Firm* — Haug Partners LLP

(57) ABSTRACT

A microphone array device including microphone capsules and at least one processing unit configured to receive output signals of the microphone capsules, dynamically steer an audio beam based on the received output signal of the microphone capsules, and generate and provide an audio output signal based on the received output signal of the microphone capsules. The processing unit is configured to operate in a dynamic beam mode where at least one focused audio beam is formed that points towards a detected audio source and in a default beam mode where a broader audio beam is formed that covers substantially a default detection area. The microphone array may be incorporated into a conference system.

12 Claims, 3 Drawing Sheets

MICROPHONE ARRAY DEVICE, CONFERENCE SYSTEM INCLUDING MICROPHONE ARRAY DEVICE AND METHOD OF CONTROLLING A MICROPHONE ARRAY DEVICE

FIELD OF THE INVENTION

The present invention relates to a microphone array device, a conference system including the microphone array device and a method of controlling a microphone array device.

BACKGROUND

It is noted that citation or identification of any document in this application is not an admission that such document is available as prior art to the present invention.

In a conference system, the speech signal of one or more participants who are typically located in a conference room must be acquired such that it can be transmitted to remote participants or for local replay, recording or other processing. Various microphone arrangements for acquiring voice signals of the participants in the conference room are known. FIG. 1 shows participants 1010 in a conference room 1000 with microphones 1100 arranged on a table 1020. On the other hand, voice signals from remote participants are received and usually replayed in the conference room via loudspeakers 1200. However, since the microphones 1100 may detect the loudspeakers 1200 replaying the remote participants' voice as a sound source, a disturbing echoing effect may occur. Thus, acoustic echo cancellation (AEC) techniques are known that aim at removing the replayed signal from the signal acquired by the microphone. Usually, an AEC unit 1210 analyzes the output signal of the microphones 1100 and the input audio signal $S_i$ and models, by an adaptive filter, an acoustic transmission path from the input audio signal $S_i$ to be replayed via the loudspeaker 1200, over-the-air transmission and microphone 1100. The output signal of the AEC unit 1210 is subtracted 1220 from the output signals of the microphones 1100 in order to compensate for the echo signal, so as to prevent the remote participants from hearing their own voice with a certain delay. An echo compensated output signal $S_o$ is obtained and provided to the remote participants. Usually, adaptation of the adaptive filter is continuously optimized while an input audio signal $S_i$ is received. If no input audio signal $S_i$ is received, or rather if the input audio signal $S_i$ is below a threshold, the adaptive filter maintains its current filter parameters.

U.S. Pat. No. 9,894,434 B2 discloses a conference system comprising a microphone array unit having a plurality of microphone capsules that are arranged in or on a board. The board is mountable on or in a ceiling e.g. of a conference room. The microphone array unit uses beam forming and has a freely steerable beam and a wide detection angle range. The conference system comprises a processing unit that is configured to receive the output signals of the microphone capsules and to steer the beam dynamically, based on the received output signal of the microphone capsules. Thus, the beam is automatically steered to a currently strongest detectable audio source, which is usually a single speaking person in the conference room. The microphone array unit may continuously track audio sources in the conference room and may react very quickly if the main speaker moves within the room or if another person in the room becomes a current main speaker.

However, the direction of the steerable beam has an impact on the acoustic transmission path. Thus, an AEC system for cancelling echoes in the output signal of the microphone array unit needs to react by adapting its filters very quickly, namely at least as quickly as the steerable beam moves. AEC systems in conventional conference systems operate almost static, since they compensate an acoustic transmission path that changes relatively slowly or not at all.

SUMMARY OF THE INVENTION

An object of the present principles is to enable or provide acoustic echo cancellation (AEC) for a microphone array device that uses dynamic beam forming, and in particular a microphone array device of the type as described above.

In an embodiment, the invention concerns a microphone array device. The microphone array device comprises a plurality of microphone capsules arranged in or on a board and a processing unit configured to receive the output signals of the microphone capsules and dynamically steer an audio beam (i.e. a direction of maximum sensitivity) based on the received output signal of the microphone capsules. The processing unit is further configured to operate in one of at least two different modes, including at least a dynamic beam mode and a default beam mode. In the dynamic beam mode, the microphone array device may detect and continuously track audio sources in its detection area, e.g. a conference room, and may react very quickly if the main speaker moves within the room or if another person in the room becomes a main speaker. In particular, the microphone array device in the dynamic beam mode forms a focused beam that may acquire a single speaker's voice. In the default beam mode, the microphone array device forms a broader directivity pattern that does not necessarily point to any particular position in space but covers a default detection area. Thus, the shape of the beam in the default beam mode is independent from the received output signal of the microphone capsules and from any detected audio source. Since the dynamic beam mode and the default beam mode may differ mainly in the way that the output signals of the microphone capsules are processed, switching between the modes can be done with virtually no delay. Additionally, a sensitivity of the microphone array device may be reduced in the default beam mode as compared to the dynamic beam mode. The microphone array device has a mode input for receiving a signal that indicates whether or not the default beam mode is to be selected.

In an embodiment, the signal received at the mode input is a signal that indicates whether or not a remote participant is talking. While the mode input signal indicates that the remote participant is talking, the processing unit switches to the default beam mode. An advantage of this mode is that an echo cancellation may become easier and much quicker, since an AEC unit may use a default echo compensation mode that is independent from the microphone array's dynamic audio beam. Thus, the AEC unit may use a default echo compensation mode that is statically or dynamically adapted to the directivity pattern of the default beam mode. Another advantage is that the microphone array device continues to acquire the voices of participants at least in a default area of the conference room, regardless where in the default area they are located, due to the broad directivity pattern. The default area may cover the complete conference room or any portion thereof. Thus, it remains possible for a local participant to interrupt a currently talking remote participant, since the microphone array is not switched off while the remote participant is talking. Generally, it is to be noted that the invention is advantageous for any echo cancellation at least for microphone arrays that use dynamic beam forming or switch beam directions too quickly for the AEC to follow. The invention can be used independent from the replayed signal, which may be e.g. a talking remote participant or any other audio signal.

In a further embodiment, the invention concerns a conference system including a microphone array device as described above, an audio reproduction device and an echo cancellation device. The audio reproduction device is adapted for reproducing an audio signal received from an external sound source, such as a remote participant. The echo cancellation device is adapted for calculating an echo compensation signal from an input audio signal received from a remote participant, and for subtracting the echo compensation signal from the microphone array device's output signal. The conference system may further comprise an activity detection unit adapted for detecting whether or not the remote participant is talking, generating a respective detection signal and providing the detection signal as a mode control signal at least to the microphone array device. In an embodiment, the detection signal may also be provided to the echo cancellation device and switch it off or inactive when the remote participant is not talking, so that no echoes occur. In another embodiment, the activity detection unit may be part of the echo cancellation device, and the echo cancellation device provides the detection signal as mode control signal to the microphone array device. The activity detection unit may be a voice activity detection unit or other sound activity detection unit. It may compare its input signal to a threshold and indicate whether or not the input signal is above the threshold.

In yet a further embodiment, the invention concerns a method of controlling a microphone array device that has a plurality of microphone capsules and may form a dynamically steerable audio beam. The method comprises steps of receiving output signals of the microphone capsules, steering the beam based on the received output signal of the microphone array unit, receiving a mode control signal, and in response to the mode control signal selecting an operating mode, wherein a first operating mode is a dynamic beam mode in which the output signals of the microphone capsules are dynamically steered to form a beam that is based on the received output signal. E.g., the beam points at a main audio source. A second operating mode is a default beam mode in which the output signals of at least some of the microphone capsules are combined to form a broader directivity pattern that is not based on the received output signal and that points at a default detection area. In embodiments, the mode control signal is derived from a voice activity signal that indicates whether or not a remote participant is talking, and the default beam mode is selected if the voice activity signal indicates that the remote participant is talking.

Further advantageous embodiments are disclosed in the detailed description below.

BRIEF DESCRIPTION OF THE DRAWINGS

Details and further advantageous embodiments of the present invention may be better understood by reference to the accompanying figures, which show in FIG. 1 shows a first known conference system with echo cancellation.

DETAILED DESCRIPTION OF PREFERRED EMBODIMENTS

Figure 1:
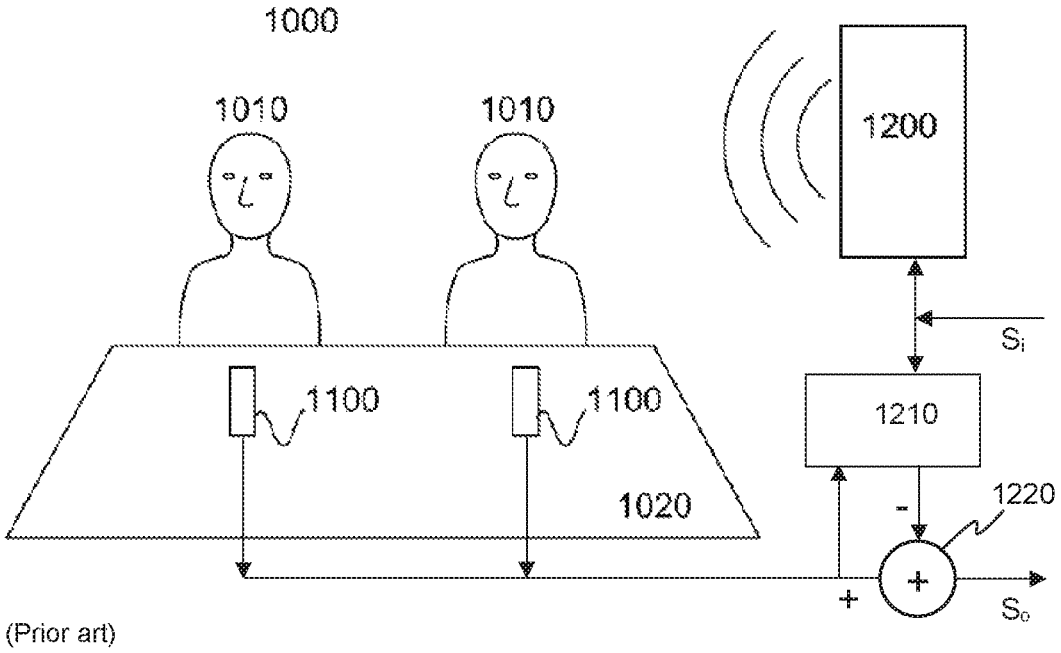
Figure 2:
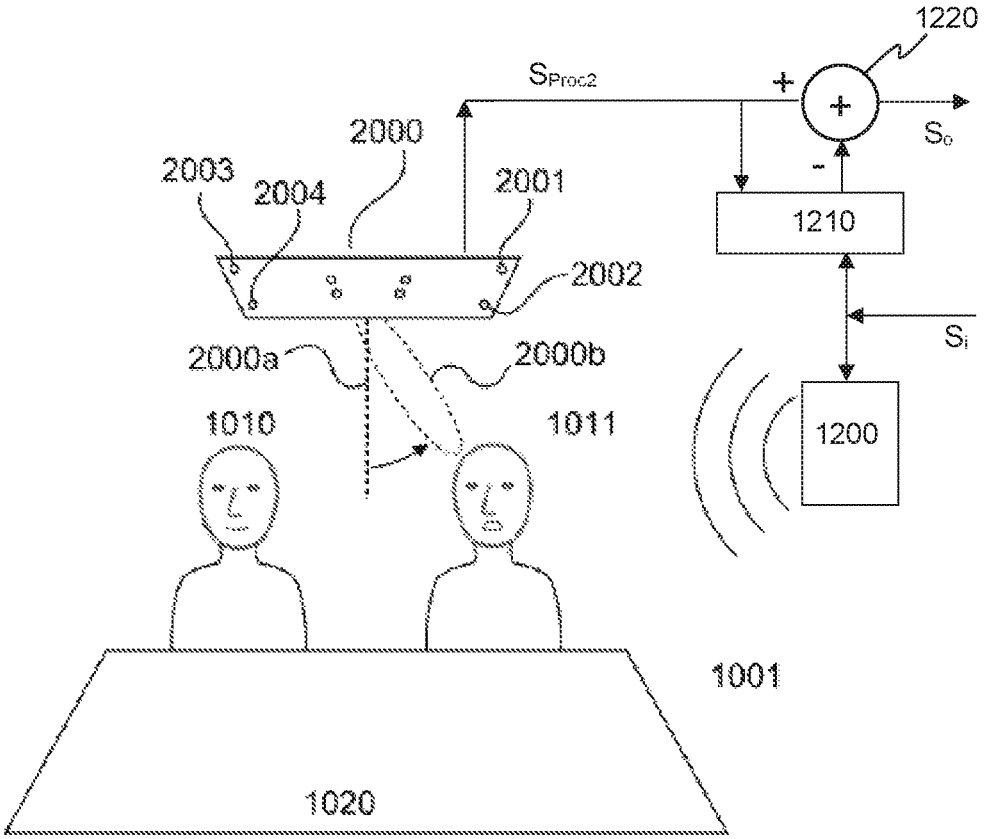
FIG. 2 shows a second known conference system enhanced by echo cancellation.

FIG. 2 shows a known conference system as disclosed in U.S. Pat. No. 9,894,434 B2, enhanced by a hypothetic acoustic echo cancelling (AEC) unit 1210. As described above, the AEC unit 1210 analyzes the audio signal $S_{Proc2}$ that is output by the microphone array 2000 and that is based on signals coming from the microphone capsules 2001-2004. The AEC unit 1200 models, by an adaptive filter, an acoustic transmission path from an external input audio signal $S_i$ to be replayed via the loudspeaker 1200, over-the-air transmission and microphone capsules 2001-2004. The microphone array 2000 uses dynamic beam forming to focus a beam 2000*b* on a talking participant 1011. The output signal of the AEC unit 1210 is subtracted 1220 from the output signal $S_{Proc2}$ of the microphone array 2000 in order to compensate for echo signals. However, as also mentioned above, the adaptive filter in the AEC unit 1210 depends on the direction of the beam 2000*b*, which may vary very quickly, e.g. within less than 100 ms or 10 times per second. However, due to the signals to be adaptively filtered, adjusting the adaptive filter must necessarily take at least longer than the audio signal needs for travelling through the acoustic path, i.e. from the loudspeaker 1200 via over-the-air transmission to the microphone array 2000. Thus, the filter needs permanent adjustment, which will require much processing power and will lead to an adaptive filtering far from optimal.

Figure 3:
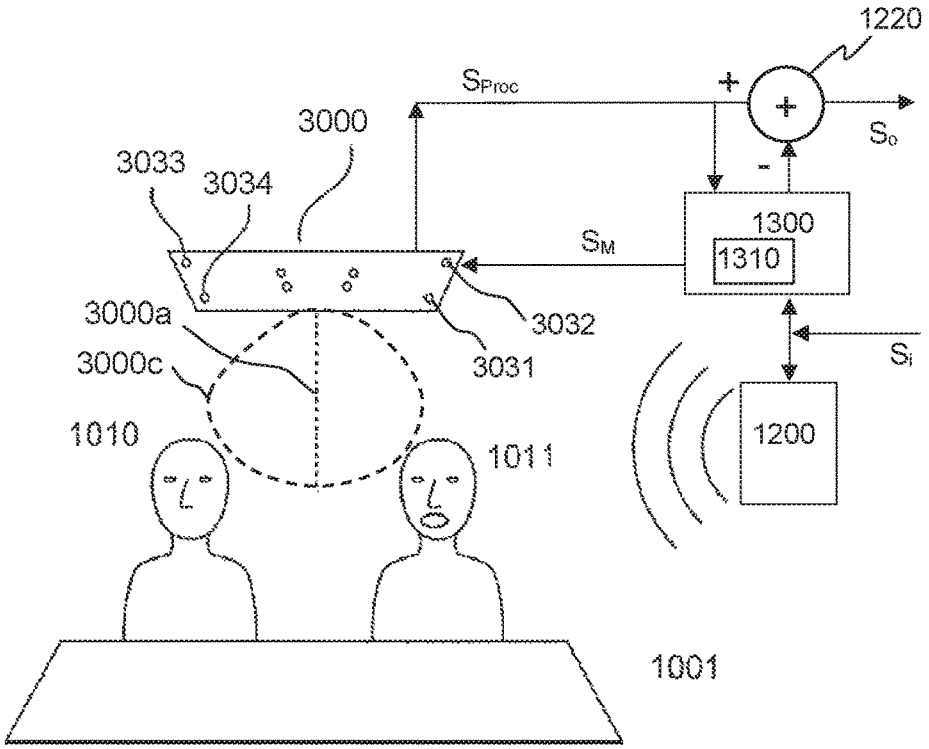
FIG. 3 shows a conference system according to an embodiment, operating in echo cancelling mode.

FIG. 3 shows a conference system according to an embodiment of the present invention, operating in echo cancelling mode in a conference room 1001. The external input signal $S_i$ from the remote participant is reproduced via loudspeaker 1200 and fed to an AEC unit 1300. The AEC unit 1300 uses the external input signal $S_i$ and the output signal $S_{Proc}$ of the microphone array device 3000 to generate a compensation signal and provides the compensation signal to a subtractor unit 1220. The subtractor unit 1220 subtracts the compensation signal from the audio output signal $S_{Proc}$ of the microphone array device 3000 to obtain an audio output signal $S_o$ of the conference system. The output signal $S_{Proc}$ of the microphone array device 3000 may be an audio signal acquired through the audio beam 3000*b* (see FIG. 4), 3000*c* based on output signals of the microphone capsules 3031-3034. The AEC unit 1300, in this embodiment, further provides a mode control signal $S_M$ to the microphone array device 3000. E.g., the mode control signal may be generated by a voice activity detection unit 1310. Generally, the voice activity detection unit 1310, the subtractor unit 1220 or both may but need not be part of the AEC unit 1300. Further, in various embodiments, the AEC unit 1300, the subtractor unit 1220 or both may be integrated in the microphone array device 3000. The mode control signal $S_M$ indicates that an audio signal is currently reproduced via the loudspeaker 1200, e.g. because a remote participant is talking. In response to the mode control signal $S_M$, the microphone array unit 3000 switches into a default beam mode. In the default beam mode, a default audio beam 3000*c* is generated, which is broader than the focused beam of the dynamic beam mode and unspecific, i.e. it is shaped independently from output signals of the microphone capsules and thus independently from any sound sources in the room. The default audio beam 3000*c* may acquire sound from all over a default detection area, e.g. the complete conference room. E.g., the default audio beam 3000*c* may be symmetric to a central axis 3000*a*. However, since the default audio beam 3000*c* is broad, it may still acquire the voice of participants 1010,1011 in the default detection area. Therefore the voice signal of a participant 1011 who begins talking during the default beam mode will be acquired and transmitted to the remote participant. If then the remote participant stops talking, the conference system will switch off the default beam mode, as described below. In one embodiment, output signals of only a subset of the microphone capsules or of only a single microphone capsule may be used in the default beam mode. In one embodiment, the default audio beam 3000*c* may cover an area directly below the microphone array, such as substantially a conference table.

Figure 4:
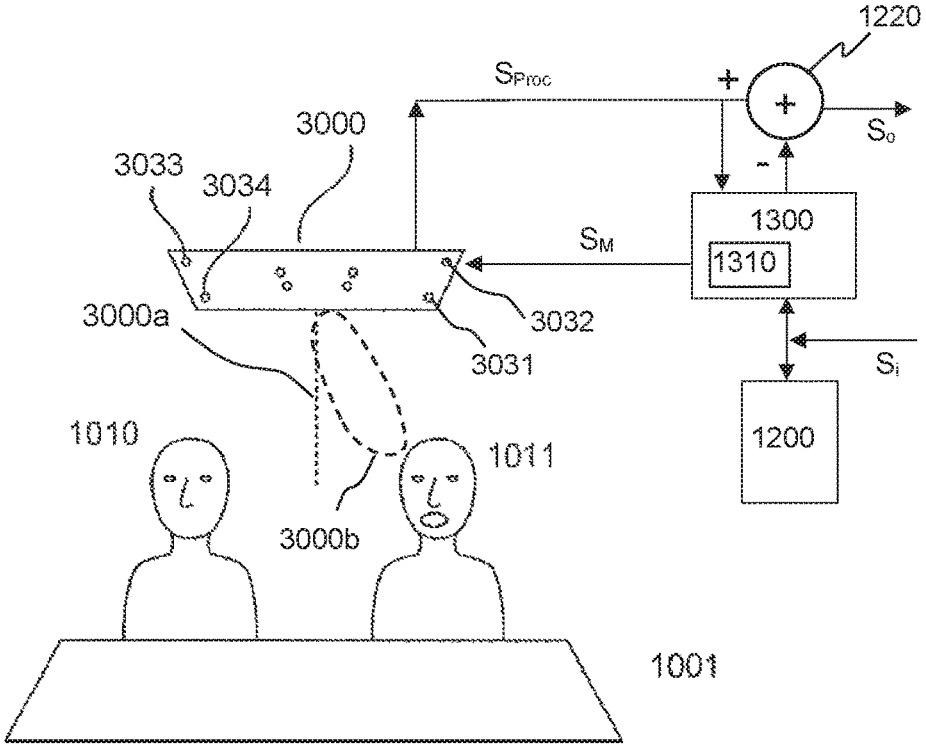
FIG. 4 shows conference system according to an embodiment, operating in talking mode.

FIG. 4 shows the same conference system as FIG. 3 but operating in a dynamic beam mode. In the depicted example, no external input signal $S_i$ is received (i.e., the external input signal indicates silence) and therefore no signal is replayed through loudspeaker 1200. Consequently, the mode control signal $S_M$ indicates to the microphone array 3000 that it may switch off the default beam mode and instead switch, e.g., to the dynamic beam mode. In the dynamic beam mode, the microphone array 3000 analyzes multiple directions for possible audio sources, detects that a talking participant 1011 is a main audio source in the room and directs a focused audio beam 3000*b* to the main audio source so as to acquire the talking participant's voice. The microphone array 3000 may continue scanning for audio sources while keeping the focused audio beam 3000*b* on the speaker, so that when another participant 1010 in the room starts talking, the other participant's voice may also be acquired immediately. In embodiments, the microphone array 3000 may permanently scan for audio sources and may use the output signals of the microphone capsules for the scanning.

In the status as shown in FIG. 4, the microphone array 3000 operates in a dynamic beam mode but will switch to the default beam mode upon receiving an external input signal $S_i$ that is above a threshold and/or a corresponding indication of the mode control signal $S_M$. In the default beam mode as shown in FIG. 3, the microphone array 3000 will switch to a dynamic beam forming mode upon receiving a "quiet" external input signal $S_i$ (i.e. below the threshold) and/or a corresponding indication of the mode control signal $S_M$. In embodiments, both switching processes may be slightly delayed in order to prevent mode switching within short pauses in speech, e.g. between words. In another embodiment, the microphone array may also switch to the default beam mode if there is silence in the conference room at least for a certain predefined time, even if the remote participant is silent or if no remote participant is connected. In one embodiment, the default audio beam 3000*c* is generally broader and more unspecific than the focused beam of the dynamic beam mode. The default audio beam statically covers a default detection area which needs not necessarily be the complete conference room (e.g. only a conference table or a podium). In one embodiment, beam forming parameters for the default audio beam, such as e.g. delay values, are pre-defined stored values. In one embodiment, various pre-defined sets of beam forming parameters may be pre-stored that correspond to different commonly used default beam shapes. A particular set of parameters may be selected in a setup or configuration procedure. In another embodiment, the beam forming parameters may be determined by dynamic beam forming and then stored, e.g. in a setup or configuration procedure. When the microphone array 3000 enters the default beam mode, the stored parameters are retrieved and applied to beam forming.

Figure 5:
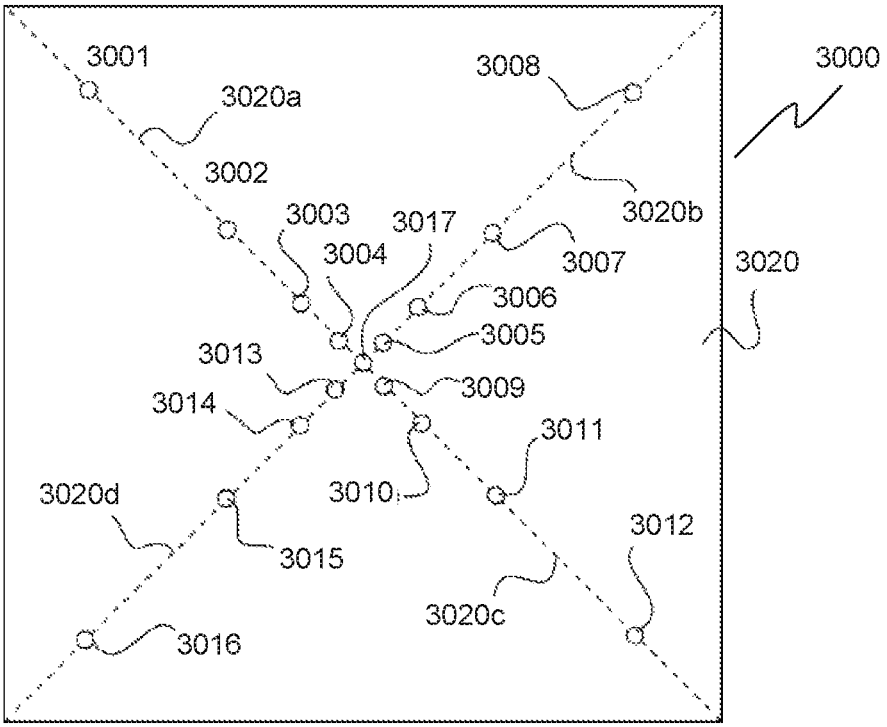
FIG. 5 shows an exemplary view of a microphone array device.

FIG. 5 shows an exemplary view of a microphone array device 3000, in one embodiment. In this example, the external view is similar to a microphone array known from the prior art. Multiple microphone capsules 3001-3016 are arranged on diagonals 3020*a*-3020*d* of a square plate 3020 mountable on or in a ceiling of a conference room. A center microphone capsule 3017 is optional. All microphone capsules 3001-3017 are on the same side of the plate 3020 in close distance to the surface. Distances between adjacent microphone capsules along the diagonals are increasing with increasing distance from the center. At least the processing unit is within the microphone array device 3000, and connectors including the mode input may be on the back (not shown in FIG. 5).

Figure 6:
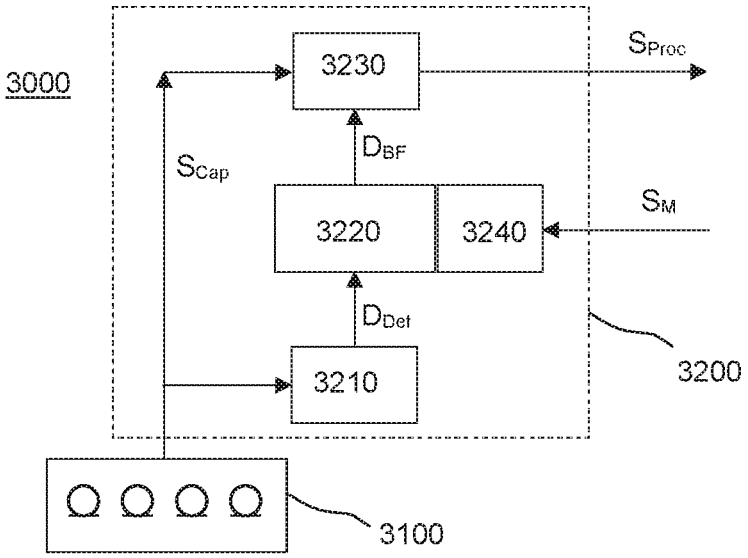
FIG. 6 shows an exemplary block diagram of a microphone array device, according to an embodiment.

FIG. 6 shows an exemplary block diagram of a microphone array device 3000, according to an embodiment. The microphone array device 3000 comprises an arrangement 3100 of a plurality of microphone capsules 3001-3017 and a processing unit 3200. In embodiments, the processing unit 3200 comprises one or more of a direction detection unit 3210 for detecting a direction of a main audio source, a beam forming unit 3230 for controlling the microphone capsule output signals $S_{Cap}$ to form an audio beam, a direction control unit 3220 for controlling the beam forming unit to point to the direction detected by the direction detection unit, and a mode control unit 3240 for controlling the operation mode of the microphone array device to be in one of at least two modes. The modes that can be selected by the mode control unit 3240 comprise at least a dynamic beam mode and a default beam mode as described above. The processing unit 3200, in particular the direction control unit 3220 or the beam forming unit 3230, may comprise or have access to a memory in which beam forming parameters at least for the default beam mode are stored. Optionally, the memory may additionally also store currently used beam forming parameters for the dynamic beam mode, e.g. when the default beam mode is entered, so that these parameters are immediately available when switching back to the other mode. This option is usually not useful for a quickly reacting dynamic beam mode as described above but may be advantageous in other cases.

In the example depicted in FIG. 6, the direction detection unit 3210 provides a direction signal $D_{Det}$ indicating a direction of a detected main audio source. It may work in both modes, dynamic beam mode and default beam mode, or be disabled during default beam mode. The direction control unit 3220 provides beam forming control signals $D_{BF}$ that are mode dependent. In the dynamic beam mode, the beam forming control signals $D_{BF}$ cause the beam forming unit 3230 to focus on one or more particular audio sources. In the default beam mode, the beam forming control signals $D_{BF}$ cause the beam forming unit 3230 to generate a broad or even omnidirectional directivity pattern from the output signals $S_{Cap}$ of the microphone capsules. The processed audio signal $S_{Proc}$ resulting from the beam forming is output. The direction control unit 3220 receives a mode input from the mode control unit 3240. In a different embodiment, the mode control unit 3240 may provide an internal mode control signal directly to the beam forming unit 3230 instead, which may e.g. simply disable any beam forming in the default beam mode. The beam forming unit 3230 may use a delay-and-sum beamformer or a filter-and-sum beamformer or any other beamformer. The processing unit 3200 may be divided into two or more distinct sub-processing units. Each processing unit or sub-processing unit may comprise one or more hardware processors configurable by software. E.g. the beamforming and the echo cancelling may be performed by two or more separate processors.

In one embodiment, the invention relates to a method of controlling a microphone array device that has a plurality of microphone capsules 3100 to form a dynamically steerable audio beam 3000*b*,3000*c*. The method comprises steps of receiving output signals $S_{Cap}$ of the microphone capsules 3001-3017, steering the beam based on the received output signals of the microphone capsules of the microphone array unit, and receiving a mode control signal $S_M$. In response to the mode control signal $S_M$, an operating mode is selected in a mode control unit 3240, wherein a first operating mode is a dynamic beam mode in which the output signals of the microphone capsules are dynamically combined to form a beam 3000*b* that is focused and points at a main audio source, and a second operating mode is a default beam mode in which the output signals of one or more of the microphone capsules are combined to form a broader directivity pattern 3000*c* that covers a default detection area. This may be e.g. a maximum sound source detection area of the microphone array device.

In embodiments, the mode control signal $S_M$ is derived from a voice activity signal or a similar signal that indicates whether or not a remote sound source is active, e.g. a remote participant is talking. The default beam mode is selected if the voice activity signal or mode control signal $S_M$ indicates that the remote sound source is active or the remote participant is talking, so that acoustic echo cancelling needs to be done.

The invention is particularly advantageous for audio and/or video conference systems.

While various different embodiments have been described, it is clear that combinations of features of different embodiments may be possible, even if not mentioned herein. Such combinations are considered to be within the scope of the present invention.

The invention claimed is:

1. A microphone array device comprising:

a plurality of microphone capsules arranged in or on a board;

a mode input; and a processing unit comprising one or more hardware processors configured to:

receive output signals of the microphone capsules;

dynamically steer an audio beam based on the received output signals of the microphone capsules; and generate and provide an audio output signal based on the received output signals of the microphone capsules;

wherein the processing unit is further configured to operate in one of at least two different modes including at least a dynamic beam mode and a default beam mode, wherein the microphone array device continuously detects audio sources in a detection area, and wherein the mode input is adapted for receiving mode control signal indicating whether or not an audio signal is reproduced via at least one loudspeaker in the detection area of the microphone array device, wherein in the dynamic beam mode at least one focused audio beam is formed that points towards a detected audio source according to the dynamical steering based on the received output signals of the microphone capsules, and wherein in the dynamic beam mode an acoustic transmission path from the at least one loudspeaker via said focused audio beam to said plurality of microphone capsules varies according to said dynamical steering, and wherein in the default beam mode a broader audio beam is formed that covers substantially a default detection area of the microphone array device, and wherein in the default beam mode an acoustic transmission path from the at least one loudspeaker via said broader audio beam to said plurality of microphone capsules is constant, and wherein the broader audio beam is independent from the received output signal of the microphone capsules.

2. The microphone array device of claim 1, wherein the processing unit comprises:

a beam forming unit adapted for combining output signals of the microphone capsules to form an audio beam;

a direction detection unit for detecting an audio source direction from the received output signal of the microphone capsules;

a direction control unit for controlling the beam forming unit to point the audio beam to the detected direction; and a mode control unit for controlling the operation of the microphone array device in one of said at least two different modes.

3. The microphone array device of claim 2, wherein:

the mode control unit switches to the default beam mode if the mode control signal indicates that an audio signal is reproduced via said at least one loudspeaker in the detection area and switches to the dynamic beam mode otherwise.

4. The microphone array device of claim 1, further comprising a memory for storing beam forming parameters to be used in the default beam mode.

5. The microphone array device of claim 1, wherein the default detection area is a maximum detection area of the microphone array device.

6. The microphone array device of claim 1, wherein the focused audio beam is adapted to cover a single person and the default audio beam is adapted to cover a plurality of persons who are in the default detection area.

7. The microphone array device of claim 1, wherein an audio sensitivity of the microphone array device in the default beam mode is reduced as compared to the dynamic beam mode.

8. A conference system comprising a microphone array device according to claim 1, the conference system further comprising:

said at least one loudspeaker adapted for reproducing an audio input signal received from an external sound source;

an echo cancellation device adapted for calculating an echo compensation signal from the audio input signal received from the external sound source and further adapted for subtracting the calculated echo compensation signal from an audio output signal of the microphone array device; and an activity detection unit adapted for receiving the audio input signal and for generating, in response to the audio input signal, said mode control signal indicating whether or not the audio input signal reproduced via the at least one loudspeaker generates audible sound within a maximum detection area of the microphone array device, wherein the activity detection unit provides the mode control signal to the microphone array device; and wherein the microphone array device is adapted for switching to the default beam mode if the mode control signal indicates that audible sound is reproduced via the at least one loudspeaker within the maximum detection area of the microphone array device, and for switching to the dynamic beam mode otherwise.

9. The microphone array device of claim 1, wherein:

an external adaptive acoustic echo canceller is connectable to the microphone array device; and the broader audio beam in the default beam mode is formed such that the external adaptive acoustic echo canceller is able to adapt to said constant acoustic transmission path from the at least one loudspeaker via the broader audio beam to the plurality of microphone capsules, and wherein the focused audio beam in the dynamic beam mode is configured to vary in time intervals too short for the adaptive acoustic echo canceller to adapt to.

10. A method of controlling a microphone array device that has a plurality of microphone capsules and that is adapted for forming a steerable audio beam for acquiring audio signals, the method comprising:

receiving output signals of the microphone capsules;

dynamically steering the audio beam based on the received output signal of the microphone capsules;

receiving a mode control signal; and in response to the mode control signal, selecting an operating mode for at least the audio beam steering, wherein a first operating mode is a dynamic beam mode in which the output signals of the microphone capsules are dynamically steered to form a beam that points at a current main audio source and in which an acoustic transmission path from a given spatial point via said beam to said plurality of microphone capsules varies according to the dynamic steering, and a second operating mode is a default beam mode in which one or more of the output signals of the microphone capsules are combined to form a broader directivity pattern that points at a default detection area and in which the acoustic transmission path from the given spatial point via said beam is constant.

11. The method of claim 10, wherein the default detection area is a maximum detection area of the microphone array device.

12. The method of claim 10, wherein in the dynamic beam mode the audio beam is adapted for acquiring a single speaker's voice and the default audio beam is adapted for acquiring voices of a plurality of persons within the default detection area.

* * * * *